US008375531B2

(12) United States Patent
Lee et al.

(10) Patent No.: US 8,375,531 B2
(45) Date of Patent: Feb. 19, 2013

(54) SEATBELT BUCKLE WITH SHOCK-PROOF DEVICE

(75) Inventors: Hyung Chan Lee, Seoul (KR); Sang Hee Park, Busan (KR); Il Hwan Park, Kimhae-si (KR); Jang Chun Kong, Changwoon-si (KR)

(73) Assignee: Samsong Industries, Ltd., Seoul (KR)

( * ) Notice: Subject to any disclaimer, the term of this patent is extended or adjusted under 35 U.S.C. 154(b) by 329 days.

(21) Appl. No.: 12/744,524

(22) PCT Filed: Nov. 21, 2008

(86) PCT No.: PCT/KR2008/006860

§ 371 (c)(1),
(2), (4) Date: May 25, 2010

(87) PCT Pub. No.: WO2009/069915

PCT Pub. Date: Jun. 4, 2009

(65) Prior Publication Data

US 2010/0263176 A1 Oct. 21, 2010

(30) Foreign Application Priority Data

Nov. 27, 2007 (KR) ..... 10-2007-0121322

(51) Int. Cl.
*A44B 11/26* (2006.01)

(52) U.S. Cl. ..... 24/641; 24/633; 24/636

(58) Field of Classification Search ..... 24/593.1, 24/625–642, 643–644
See application file for complete search history.

(56) References Cited

U.S. PATENT DOCUMENTS

| | | | | | |
|---|---|---|---|---|---|
| 4,310,952 | A * | 1/1982 | Robben et al. | ..... | 24/641 |
| 5,119,532 | A * | 6/1992 | Tanaka | ..... | 24/641 |
| 5,177,839 | A * | 1/1993 | Seto | ..... | 24/641 |
| 5,341,546 | A * | 8/1994 | Burke | ..... | 24/641 |
| 5,752,299 | A * | 5/1998 | Vivacqua et al. | ..... | 24/633 |
| 5,839,174 | A * | 11/1998 | Chamings et al. | ..... | 24/633 |
| 6,216,323 | B1 | 4/2001 | Oyamada | | |
| 6,550,112 | B2 * | 4/2003 | Rohrle et al. | ..... | 24/641 |

(Continued)

FOREIGN PATENT DOCUMENTS

| | | | |
|---|---|---|---|
| DE | 9202526.9 | U1 | 4/1992 |
| JP | 2005-144138 | A | 6/2005 |

(Continued)

OTHER PUBLICATIONS

International Search Report for International Application No. PCT/KR2008/006860, Mailing Date Jul. 6, 2009.

*Primary Examiner* — Robert J Sandy
*Assistant Examiner* — Louis Mercado
(74) *Attorney, Agent, or Firm* — LRK Patent Law Firm

(57) ABSTRACT

A shockproof device installed to a seatbelt buckle, which is provided in an automobile, airplane, etc, fastened around a seat to keep a passenger safely secured, is installed behind a release button and lock pin, to prevent the release button from being unexpectedly released when the release button is moved in a non-release direction. Even when the release button and lock pin are moved in a release direction, on the basis of a rotation angular velocity of the inertia lever rather than a rotation torque thereof, surface contact between the lock pin and the inertia lever is accomplished and simultaneously, owing to an anti-rotation configuration thereof, the inertia lever reliably prevents unexpected disengagement between the tongue plate and the buckle under the influence of any magnitude of inertial force.

11 Claims, 9 Drawing Sheets

U.S. PATENT DOCUMENTS

| | | | | |
|---|---|---|---|---|
| 6,701,587 | B1 * | 3/2004 | Sato et al. | 24/633 |
| 7,124,481 | B2 * | 10/2006 | Sato et al. | 24/641 |
| 7,426,774 | B2 * | 9/2008 | Yamada | 24/641 |
| 2007/0107173 | A1 * | 5/2007 | Yamada | 24/636 |

FOREIGN PATENT DOCUMENTS

| | | | |
|---|---|---|---|
| KR | 10-1996-0028855 | A | 8/1996 |
| KR | 10-2001-0053014 | A | 6/2001 |

* cited by examiner

SEATBELT BUCKLE WITH SHOCK-PROOF DEVICE

TECHNICAL FIELD

The present invention relates to a seatbelt apparatus provided in an automobile, airplane, etc., fastened around a seat to keep a passenger safely secured, and a buckle for the seatbelt apparatus. More particularly, the present invention relates to a shockproof device installed to a seatbelt buckle, wherein an inertia lever is provided to prevent a release button from unexpectedly releasing engagement between the buckle and a tongue plate inserted into the buckle under the influence of inertial force.

BACKGROUND ART

Typically, a seat of an automobile, airplane, or the like is provided with a seatbelt to protect a passenger in the event of an accidental collision, etc. To assure easy and simple attachment/detachment of such a seatbelt, the seatbelt is generally provided with a buckle. Conventionally, the seatbelt buckle consists of a lock mechanism having a lock plate, into which a tongue plate is inserted and locked, and a release mechanism having a release button to enable the tongue plate to be ejected out of the buckle.

In the conventional seatbelt buckle, to fasten the seatbelt around a passenger, a tongue plate, which is supported by the seatbelt, is inserted into the buckle in such a manner that the lock plate is inserted into a coupling hole of the tongue plate and simultaneously, an anti-release pin is located at a position to restrict upward movement of the lock plate. Then, to eject the tongue plate out of the buckle, the release button, which is used to release engagement between the tongue plate and the buckle, is pressed in a release direction, causing the anti-release pin to be moved to a non-coupling position. In a state wherein the tongue plate is completely inserted into a body of the buckle to thereby be locked in the buckle, in order to reliably maintain the locking of the tongue plate even if an external shock is applied to the buckle, a spring is provided to continuously press the lock plate to the locking position. The spring also serves to return the release button to an original position thereof. To facilitate easy engagement and disengagement between the tongue plate and the buckle, the release button is configured to release when only a slight force is applied thereto.

Recently, there have been proposed safety devices for preventing occurrence of several troubles, such as for example, a seatbelt pre-tensioner to prevent a seatbelt from being loosened from a passenger upon accidental collision of a vehicle, or a buckle pre-tensioner to pull down a buckle using instantaneous explosive power.

However, the pre-tensioner, which is proposed to prevent troubles caused by the loosened seatbelt, may apply instantaneous acceleration to the buckle during operation thereof, and thus, there is a risk that the locking of the tongue plate is unexpectedly released even though the release button is not pressed, causing ejection of the tongue plate out of the buckle. More specifically, if the buckle is instantaneously pulled to tension the tongue plate, or the tongue plate itself is pulled and tensioned, inertial force is applied to the release button or the anti-release pin in a release direction, causing the tongue plate to be forcibly released from the locked state thereof and be ejected out of the buckle.

In the case of the above-described conventional seatbelt buckle with no shockproof device, one might consider enhancing the elasticity of the spring used to press the release button, in order to prevent the unexpected ejection of the tongue plate. However, this requires an increase in the size of the spring, and consequently, an increase in a press force (i.e. release force) of the release button required to release the locking of the tongue plate against the spring, resulting in deterioration in safety.

For this reason, there have recently been proposed a variety of buckles with a shockproof device to effectively deal with inertial force of the buckle caused upon rapid acceleration. The shockproof device for a seatbelt buckle is configured in such a manner that an inertia lever is pivotally rotatably coupled to a body base inside the buckle so as to prevent unexpected movement of a release button in a release direction.

FIG. 1 illustrates one example of a conventional seatbelt buckle with a shockproof device, which is disclosed in German Patent Publication No. DE 9202526.9 U1. In the disclosed conventional seatbelt buckle with the shockproof device, regardless of movement of a release button in a release direction or a non-release direction, inertial force of the release button is applied to an inertia lever in a direction perpendicular to the movement direction of the release button. In the conventional shockproof device shown in FIG. 1, the inertia lever acts to remove the inertial force of the release button caused when the release button is moved in the release direction, thereby restricting the release movement of the release button. However, in order to reliably restrict the release movement of the release button, it is necessary to set an inertial force moment of the inertia lever higher than that of the release button.

In the above-described conventional shockproof device, under the assumption of setting a positive moment, if the release button is forced in a non-release direction, the release button is moved in the non-release direction by inertial force thereof. However, there is a risk that inertial force of the inertia lever, which comes into contact, at a cylindrical periphery thereof, with a straight vertical surface of the release button, is excessively larger than the inertial force of the release button that will be moved in the non-release direction, causing the release button to be unexpectedly moved in a release direction. Further, in the above-described shockproof device, although it is possible to set the same positive moment, this makes it difficult for the inertia lever to effectively deal with the inertial force of the release button with respect to the release direction or non-release direction, resulting in unreliable restriction in the release movement of the release button.

FIG. 2 illustrates another example of a conventional seatbelt buckle with a shockproof device, which is disclosed in Japanese Patent Publication No. 2005-0144138. The disclosed shockproof device includes means to generate a difference between a torque acting on an inertia lever by inertial force of a release button with respect to a release direction and a torque acting on the inertia lever by inertial force of the release button with respect to a non-release direction, so as to reliably maintain a tongue plate inside the buckle, regardless of the inertial force of the release button in any direction.

A problem of the conventional shockproof device shown in FIG. 1 is that, if the inertial force moment of the inertia lever is not equal to the inertial force moment of the release button, under the influence of inertial force of the release button not only in the release direction but also in the non-release direction, it is impossible to prevent the release button from being moved in a release direction using the inertia lever. Moreover, according to the direction of the inertial force, it may be difficult to reliably prevent disengagement between the tongue plate and the buckle.

A problem of the conventional shockproof device shown in FIG. 2 is that setting greater inertial force of the inertia lever than that of the release button to compensate for the inertial force of the release button so as to prevent disengagement between the tongue plate and the buckle requires an excessive increase in the mass and volume of the inertial lever.

In the above-described conventional seatbelt buckles using the inertia lever configured to be brought into contact with the release button, or the inertia lever configured to create inertial force moment sufficient to compensate for the inertial force of the release button, nonferrous metals or metal powders for sintering having a high specific gravity must be used due to a need to increase the mass and volume of the inertia lever. This inevitably results in increased material costs and high manufacturing costs depending on fabrication techniques. Furthermore, when the release button is pressed to release the seatbelt buckle, the heavy weight of the inertia lever may cause an excessive increase in disengagement force of the buckle. In addition, unnecessary operations of the inertia lever during general fastening/unfastening of the seatbelt buckle may cause failures in interconnections of components inside the buckle.

DISCLOSURE OF INVENTION

TECHNICAL PROBLEM

Therefore, the present invention has been made in view of the above problems, and it is an object of the present invention to provide a seatbelt buckle with a shockproof device, which can reliably prevent disengagement between the buckle and a tongue plate inserted into the buckle under the influence of inertial force regardless of the magnitude and direction of inertial force, thereby restricting disengagement force to the maximum extent and reducing manufacturing costs.

Technical Solution

In accordance with an aspect of the present invention, the above and other objects can be accomplished by the provision of a seatbelt buckle with a shockproof device, wherein the shockproof device is installed behind a release button and lock pin so as to completely prevent the release button from being unexpectedly released when the release button is moved in a non-release direction, and wherein, even when the release button and lock pin are moved in a release direction, on the basis of a rotation angular velocity of the inertia lever rather than a rotation torque of the inertia lever, surface contact between the lock pin and the inertia lever is accomplished, and simultaneously, owing to an anti-rotation configuration thereof, the inertia lever reliably prevents unexpected disengagement between the tongue plate and the buckle under the influence of any magnitude of inertial force. Further, due to the fact that there is no need to increase the weight of the inertia lever, fabricating the shockproof device using a metal plate is possible, resulting in enhanced price competitiveness. In the case of the conventional shockproof device previously described herein, the shockproof device is directly linked to the release button and thus, operation of the shockproof device interferes with operation of the release button even during general operations of the seatbelt buckle, causing an increased possibility of disengagement. However, according to the present invention, there is no linkage in operation between the shockproof device and the release button, and this has the effect of preventing generation of operating noises, and the resulting configuration of the present invention enables easy reduction in the overall weight of the seatbelt buckle as compared to the conventional configuration.

Advantageous Effects

According to the present invention, the following effects can be accomplished. Firstly, with a configuration wherein a shockproof device is installed behind a release button and lock pin, the shockproof device can completely prevent the release button from being unexpectedly released when the release button is moved in a non-release direction. In addition, even when the release button and lock pin are moved in a release direction, on the basis of a rotation angular velocity of the inertia lever rather than a rotation torque of the inertia lever, surface contact between the lock pin and the inertia lever can be accomplished, and simultaneously, owing to an anti-rotation configuration thereof, the inertia lever can reliably prevent unexpected disengagement between the tongue plate and the buckle under the influence of any magnitude of inertial force. Further, as a result of eliminating a need to increase the weight of the inertia lever, the shockproof device can be fabricated by a simple press method, and can easily achieve a reduction in the overall weight and manufacturing costs of the seatbelt buckle with the shockproof device.

BRIEF DESCRIPTION OF DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
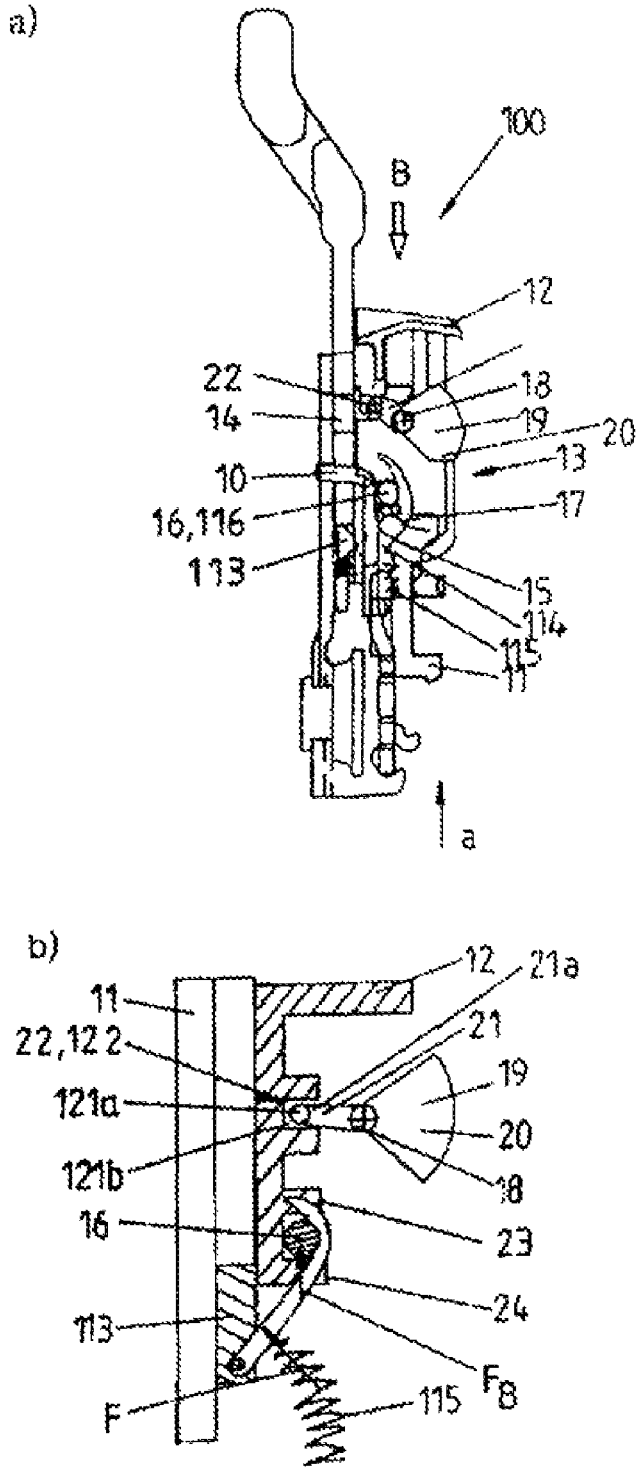
FIG. 1 PRIOR ART
FIG. 1 is a configuration view illustrating a conventional seatbelt buckle with a shockproof device.
Figure 2:
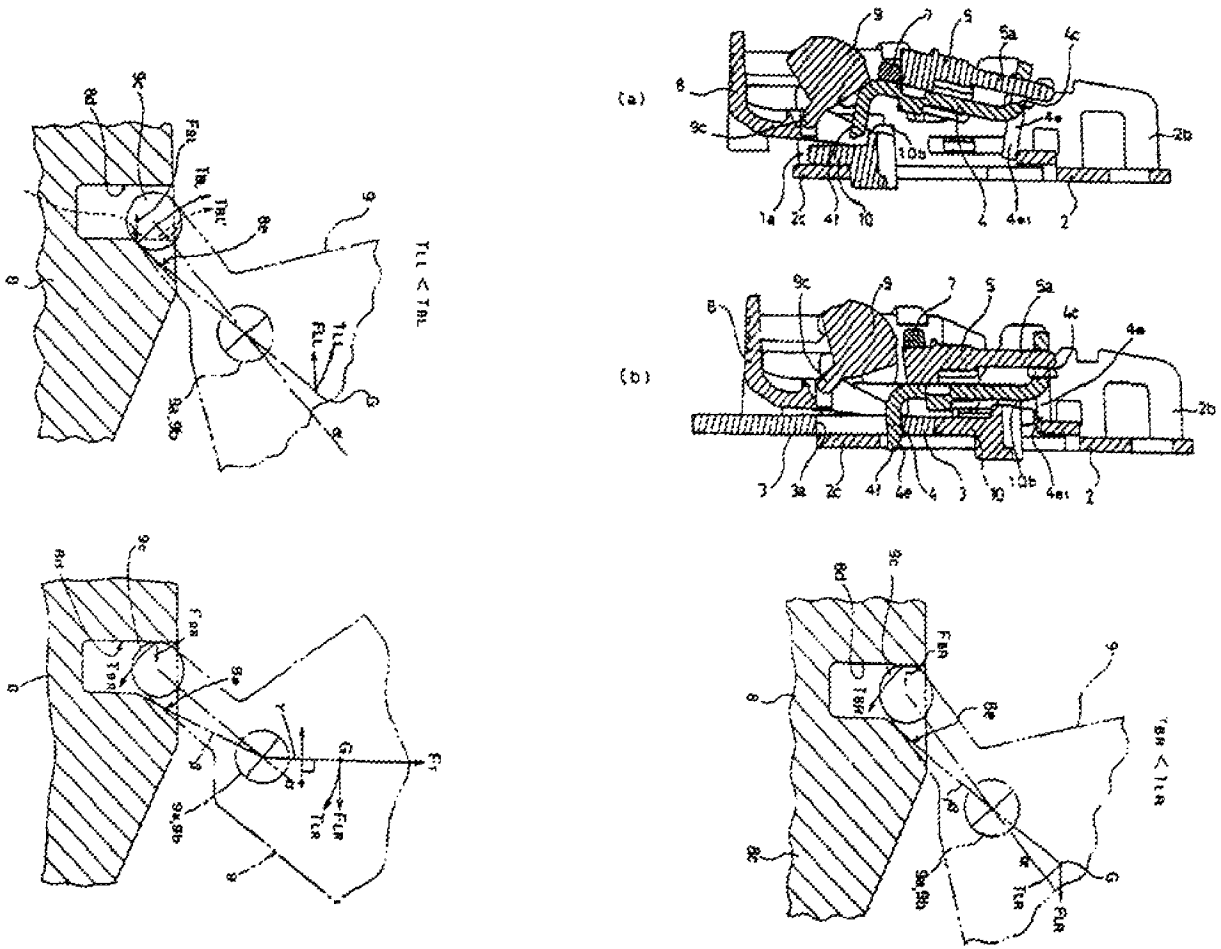
FIG. 2 PRIOR ART
FIG. 2 is a configuration view illustrating another conventional seatbelt buckle with a shockproof device.

In accordance with the present invention, there is provided a seatbelt buckle with a shockproof device including: a release button 1 to release a lock mechanism; an ejector 2 to eject a tongue plate out of the buckle using elasticity of an ejector spring 3 coupled thereto; a lock pin 4 used to operate the release button 1 and configured to be brought into contact with an inertia lever 7; a lock spring 5 to press and return the release button 1 to an initial position; a lock plate 6 having a latch 6*a* to restrict unexpected ejection of the tongue plate; the inertia lever 7 to prevent movement of the release button 1 and lock pin 4 under the influence of inertial force; a torsion spring 8 to support operation of the inertia lever 7; and a base 9 in which the above components are received, the base 9 being coupled with the release button 1, wherein the inertia lever 7 includes: pivoting holes 7*a* and 7*b*, into which pivoting shafts 9*c* and 9*d* of the base 9 are fitted, upon movement of the inertia lever 7 in a release direction; and rotation restrictors 7*g* and 7*h* to prevent the inertia lever 7 from being rotated in a non-release direction, the rotation restrictors 7*g* and 7*h* being disposed on seating portions 9*m* and 9*n* of the base, and wherein the torsion spring includes: a rod 8*c* to be brought into contact with and be caught by holding recesses 7*l* and 7*m* of the inertia lever 7; coils 8*d* and 8*e* supported on first supporters 9*e* and 9*f* of the base 9; and holding portions 8*a* and 8*b* supported on second supporters 9*g* and 9*h* of the base 9.

Mode for the Invention

Hereinafter, the present invention will be described in detail with reference to the accompanying drawings.

Figure 3:
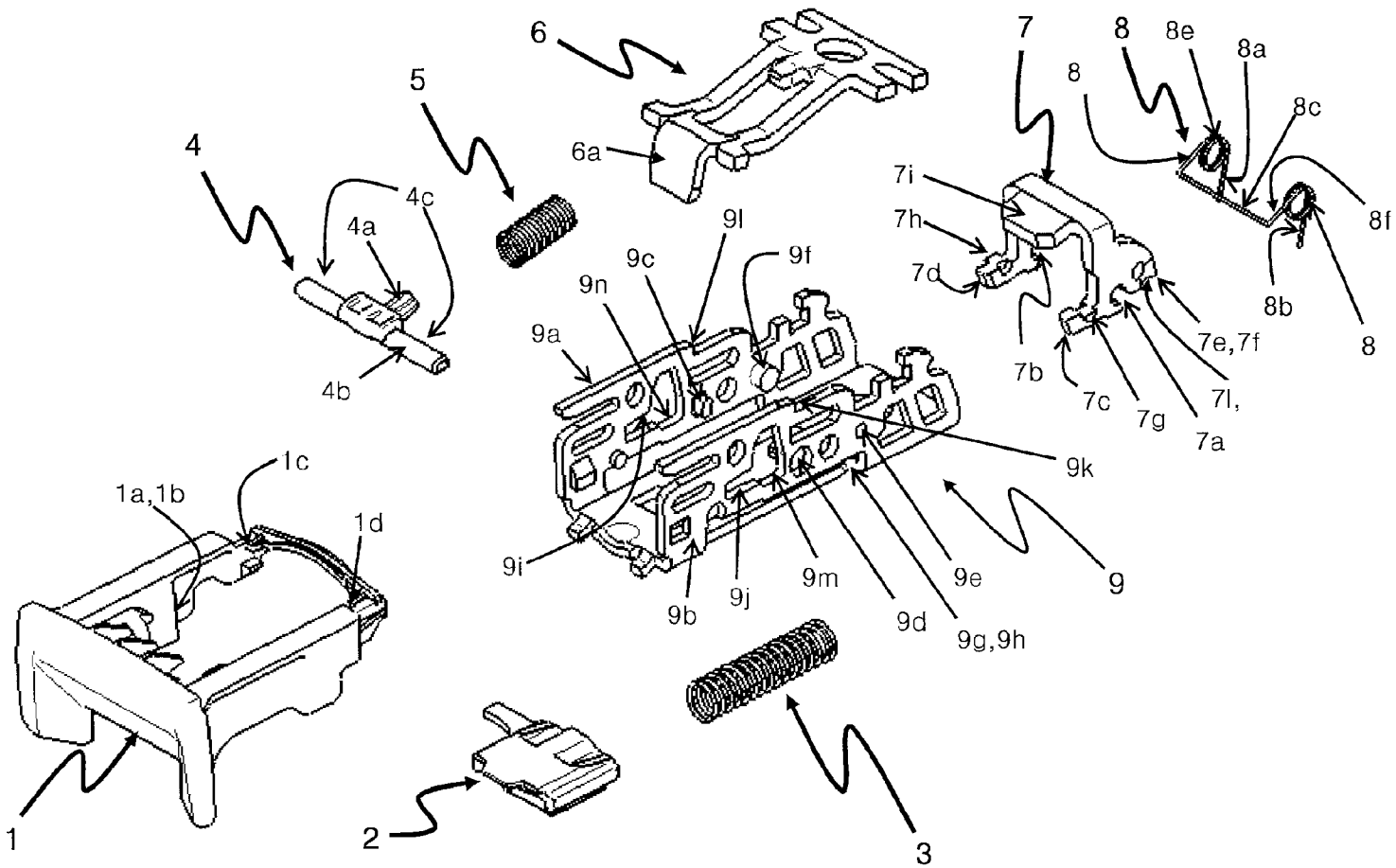
FIG. 3 is an exploded perspective view illustrating a seatbelt buckle with a shockproof device in accordance with the present invention.
Figure 4A:
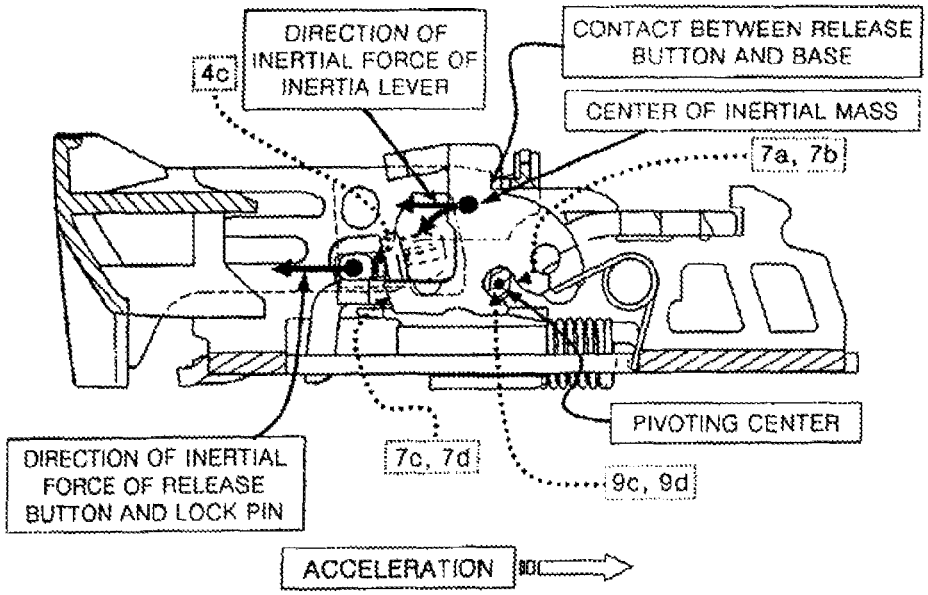
FIG. 4 is a detailed view illustrating operation of the seatbelt buckle in accordance with the present invention.
Figure 4B:
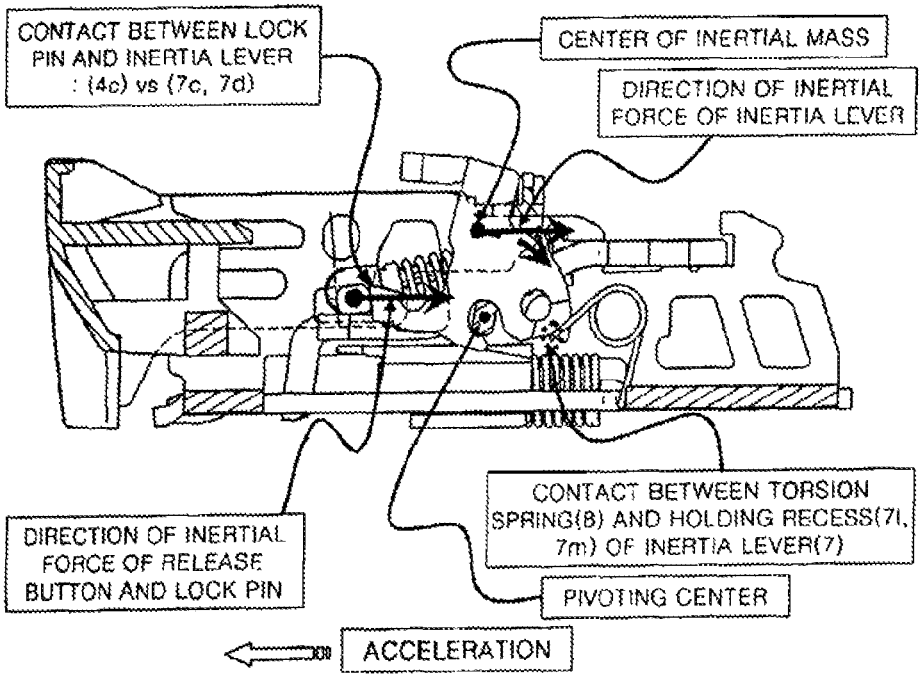
Figure 5A:
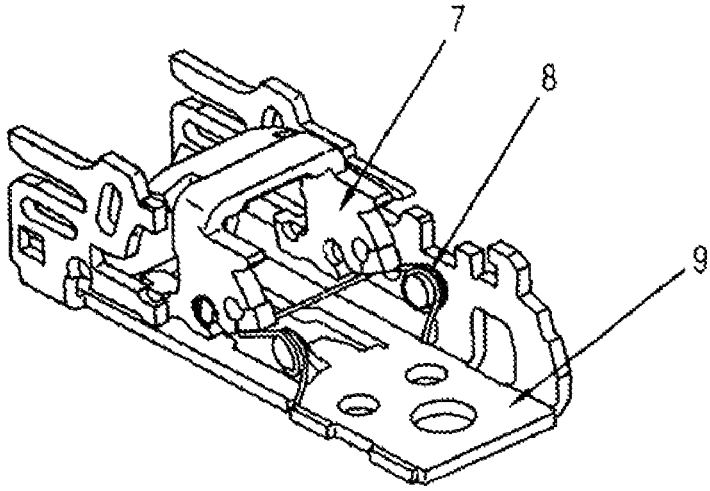
FIG. 5 is a configuration view illustrating an inertia lever and torsion spring coupled to a base in accordance with the present invention.
Figure 5B:
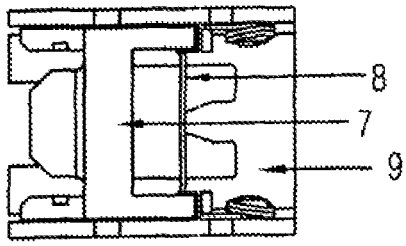
Figure 5C:
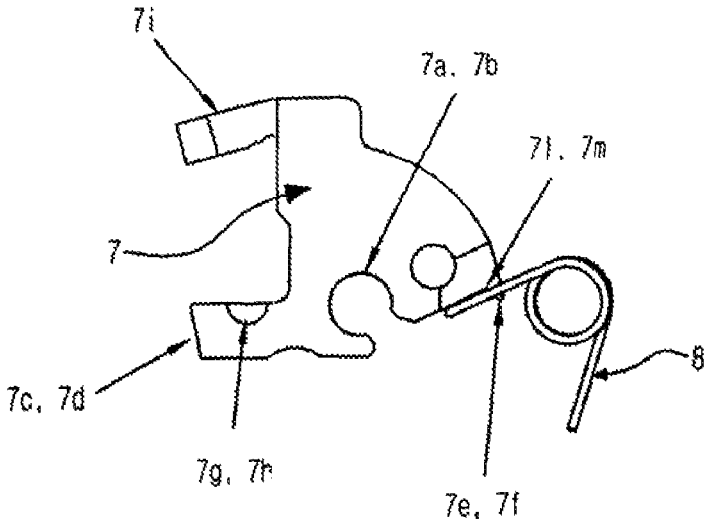
Figure 6A:
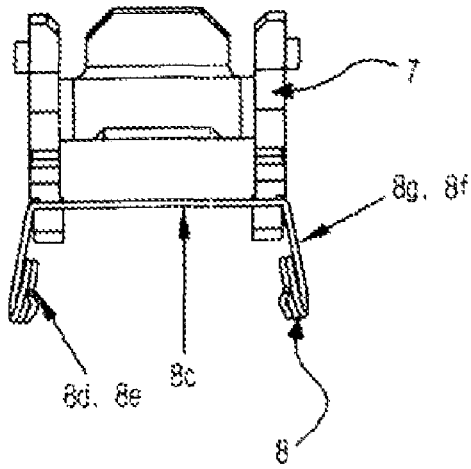
FIG. 6 is a configuration view of the torsion spring in accordance with the present invention.
Figure 6B:
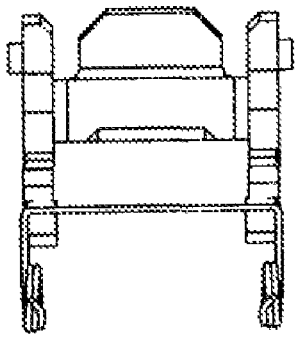
Figure 6C:
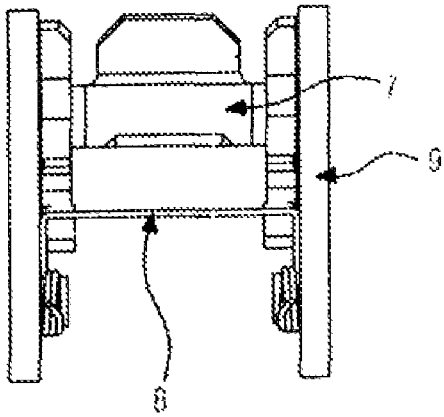
Figure 7:
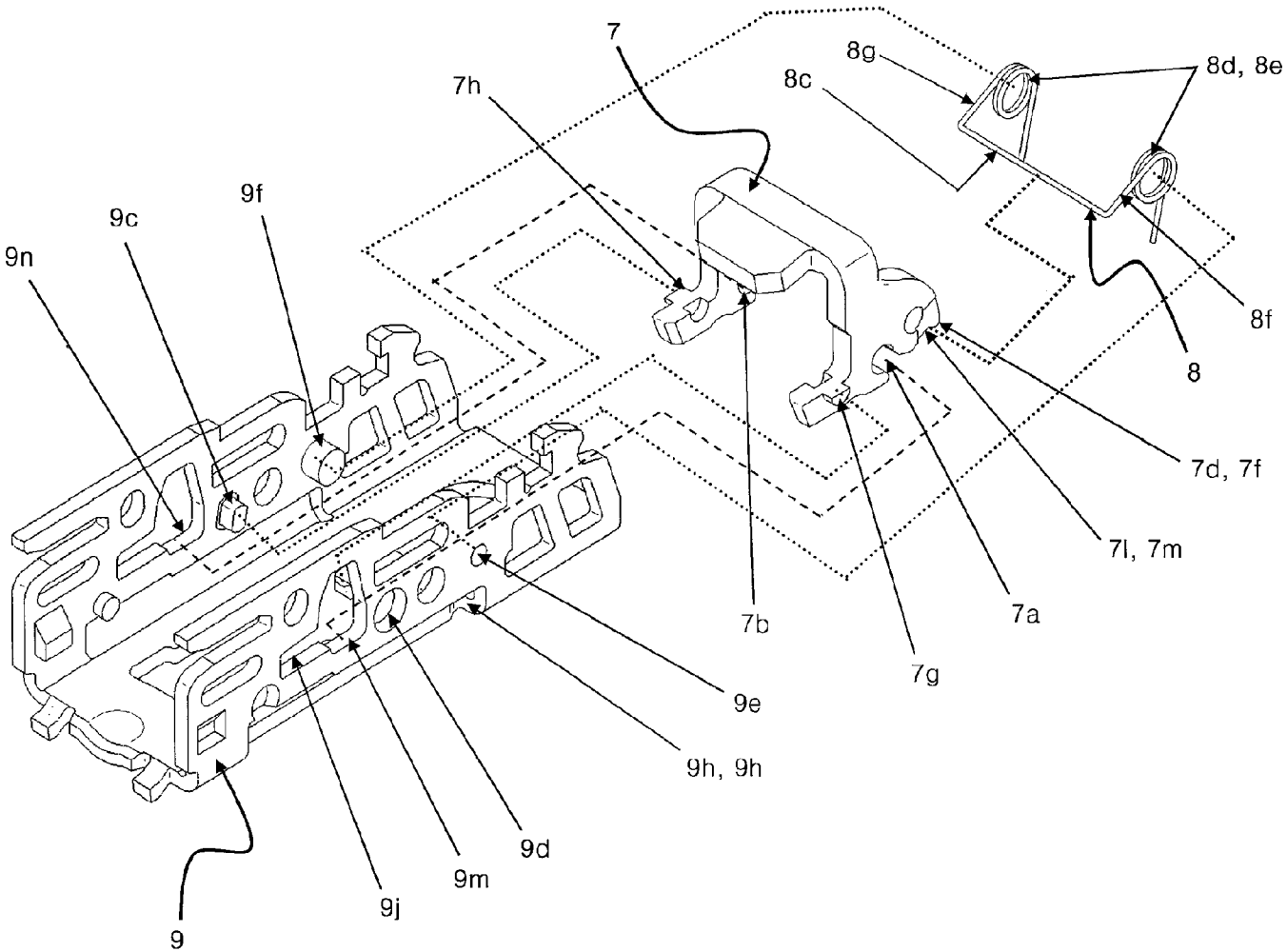
FIG. 7 is an exploded perspective view illustrating coupling relationship between the base, inertia lever and torsion spring in accordance with the present invention.
Figure 8A:
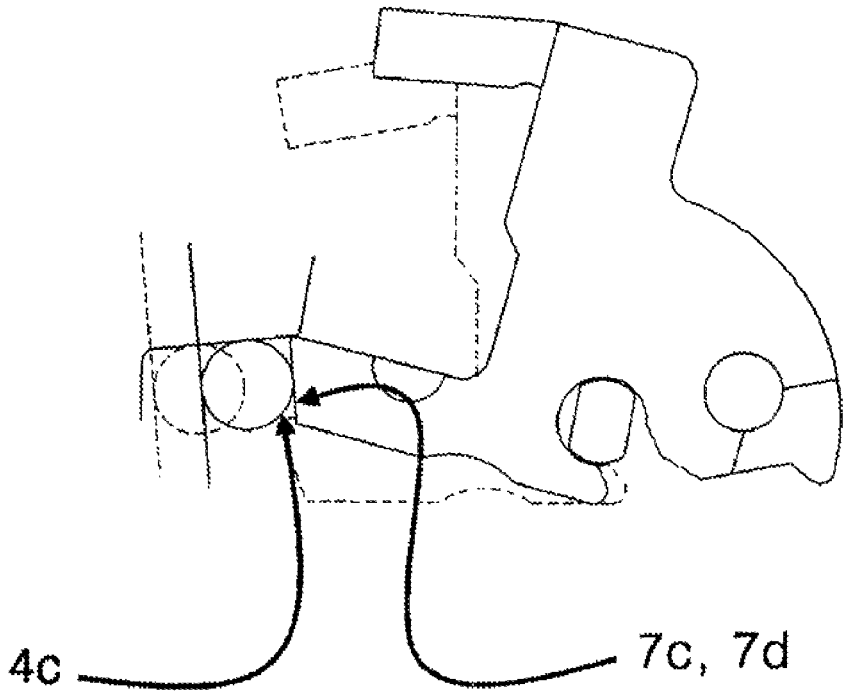
FIG. 8 is a configuration view illustrating alternative embodiments of a movement restrictor of the inertia lever and a contact portion of a lock pin in accordance with the present invention.
Figure 8B:
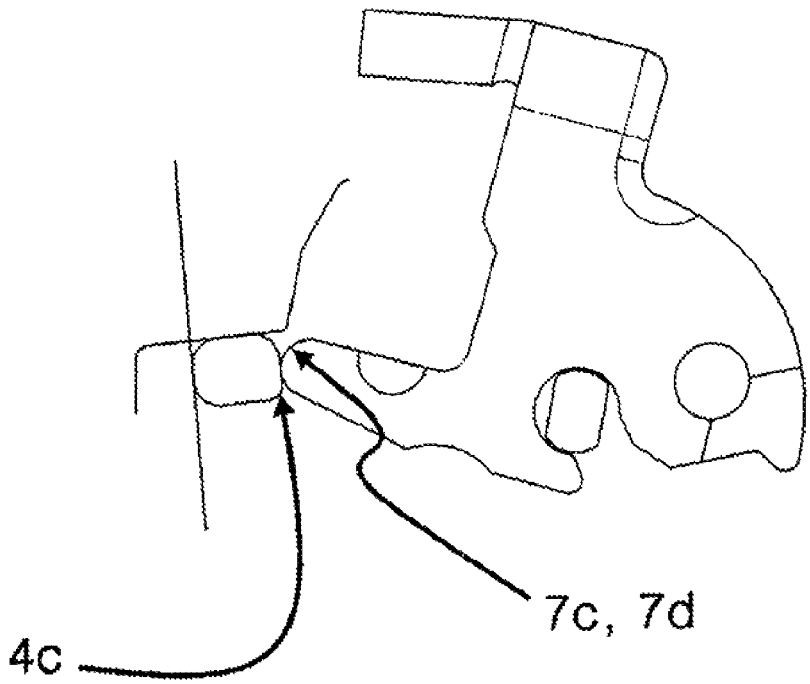

FIG. 3 is an exploded perspective view illustrating a seatbelt buckle with a shockproof device in accordance with the present invention, FIG. 4 is a detailed view illustrating operation of the seatbelt buckle. FIG. 5 illustrates an inertia lever and torsion spring coupled to a base in accordance with the present invention, FIG. 5A being a perspective view, FIG. 5B being a plan view, and FIG. 5C being a sectional view of the inertial lever. FIG. 6 is a configuration view of the torsion spring in accordance with the present invention, and FIG. 7 is an exploded perspective view illustrating coupling relationship between the base, inertia lever and torsion spring in accordance with the present invention. Also, FIG. 8 is a configuration view illustrating alternative embodiments of a movement restrictor of the inertia lever and a contact portion of a lock pin in accordance with the present invention, and FIG. 9 is a configuration view illustrating alternative embodiments of the coupling relationship between the inertia lever and the base in accordance with the present invention.

As shown in FIG. 3, the seatbelt buckle according to the present invention includes a release button 1, an ejector 2, an ejector spring 3, a lock pin 4, a lock spring 5, a lock plate 6, an inertia lever 7, a torsion spring 8, and a base 9.

The release button 1 is provided, at opposite sidewalls thereof, with slopes 1*a* and 1*b* to push the lock pin 4 for release of a lock mechanism. The release button 1 is further provided with stoppers 1*c* and 1*d* to prevent unexpected separation of the release button 1 from a body of the base 9. In addition, although not shown, the release button 1 is provided with a movement guide. The ejector 2 serves to eject a tongue plate out of the buckle. For this, the ejector spring 3 is coupled to the ejector 2. That is, the ejector spring 3 provides the ejector 2 with a force required to eject the tongue plate out of the buckle.

The lock pin 4 includes a supporting portion 4*a* for supporting the lock spring 5, a push portion 4*b* to push the release button 1, and a contact portion 4*c* to be brought into contact with the inertia lever 7 when the lock pin 4 is moved in a release direction under the influence of inertial force. The lock spring 5 is coupled to the lock pin 4 in such a manner that the lock spring 5 provides the lock pin 4 with a force required to press the release button 1 so as to return the release button 1 to an initial position thereof. The lock plate 6 has a latch 6*a* to prevent unexpected ejection of the tongue plate.

The inertia lever 7 includes pivoting holes 7*a* and 7*b*, movement restrictors 7*c* and 7*d* to prevent movement of the inertia lever 7 in a release direction due to inertial force of the release button 1 and lock pin 4, rotation restrictors 7*g* and 7*h* to prevent the inertia lever 7 from being rotated in a non-release direction of the release button 1 and lock pin 4 under the influence of inertial force, stoppers 7*e* and 7*f* to prevent over-rotation of the inertia lever 7 in a release direction, holding recesses 7*l* and 7*m* provided to be brought into contact with and caught by the torsion spring 8, and a weight 7*i* to increase a rotation angular velocity of the inertia lever 7.

The torsion spring 8 includes a rod 8*c* configured to be brought into contact with and caught by the holding recesses 7*l* and 7*m*, coils 8*d* and 8*e* provided at opposite ends of the rod 8*c* and configured to be coupled to the base 9, arms 8*f* and 8*g* provided between the rod 8*c* and the respective coils 8*d* and 8*e* and used to press opposite sidewalls of the inertia lever 7, and holding portions 8*a* and 8*b* extending downward from the respective coils 8*d* and 8*e* so as to be coupled to the bottom of the base 9.

The base 9 internally defines an insertion path (not shown) of a tongue plate having a coupling hole, and a pair of upright sidewalls 9*a* and 9*b* is provided at opposite sides of the insertion path. The base 9 has a coupling slot (not shown), through which the latch 6*a* of the lock plate 6 is inserted. The base 9 further has pivoting shafts 9*c* and 9*d* provided at the sidewalls 9*a* and 9*b*, respectively, so as to be rotatably fitted into the respective pivoting holes 7*a* and 7*b* of the inertia lever 7, and seating portions 9*m* and 9*b* on which the rotation restrictors 7*g* and 7*h* of the inertia lever 7, which serve to prevent the inertia lever 7 from being rotated in a non-release direction, are seated. In addition, to eliminate frequent oscillations of the inertia lever 7 while enabling correction of a position of the inertia lever 7, the base 9 is provided with first supporters 9*e* and 9*f* to support the coils 8*d* and 8*e* of the torsion spring 8 and second supporters 9*g* and 9*h* to support the holding portions 8*a* and 8*b* of the torsion spring 8. The base 9 further defines lock pin movement passages 9*i* and 9*j* through which the lock pin 4 is coupled to keep the lock plate 6 stably locked, and a movement passage (not shown) for the movement guide (not shown) of the release button 1. To prevent the release button 1 from being unexpectedly separated from the interior of the buckle, the base 9 further has anti-separating portions 9*k* and 9*l*.

As shown in FIGS. 4 and 5, in the seatbelt buckle having the above-described configuration, if acceleration is applied to the buckle due to accidental collision or via operation of a pre-tensioner provided in a seatbelt retractor, etc., some elements installed inside of the buckle, which are not affected by tensile force, tend to be moved in a specific direction under the influence of inertial force. In particular, when acceleration is applied in a pulling direction of the pre-tensioner, this causes the release button 1 and lock pin 4 to be moved in a release direction, and simultaneously, causes the inertia lever 7 to be rotated under the influence of the same inertial force caused in the release button 1 and lock pin 4. As a result, the contact portion 4*c* of the lock pin 4 is brought into contact with the movement restrictors 7*c* and 7*d* of the inertia lever 7, whereby movement of the inertia lever 7 due to the inertial force is prevented.

In this case, to allow the movement restrictors 7*c* and 7*d* of the inertia lever 7 to reach a release restricting position earlier than the contact portion 4*c* of the lock pin 4 and the release button 1 when the lock pin 4 and release button 1 are moved in a release direction under the influence of inertial force, the inertia lever 7 is provided at a top position thereof with the weight 7*i*. With the provision of the weight 7*i*, a rotation angular velocity of the inertia lever 7 can be set to be faster than a movement velocity of the lock pin 4 and release button 1. Here, the weight 7*i* functions to position a center of inertial mass at a further increased distance from a rotating center of the inertia lever 7 on a vertical axis, thereby more reliably preventing disengagement between the tongue plate and the buckle.

In the present invention, the movement restrictors 7*c* and 7*d* of the inertia lever 7 and the contact portion 4*c* of the lock pin 4 are configured to achieve surface-contact therebetween. For this, the contact portion 4*c* has a straight line form, whereas the movement restrictors 7*c* and 7*d* are obliquely formed with a slight inclination. With this configuration, although a force to rotate the inertia lever 7 under the influence of inertial force is generated if the contact portion 4*c* of the lock pin 4 pushes the movement restrictors 7*c* and 7*d* of the inertia lever 7, the movement passages 9*i* and 9*j* for the lock pin 4 defined in the base 9 act to restrict an upward movement force of the lock pin 4. Accordingly, in combination with the surface contact between the movement restrictors 7*c* and 7*d* and the contact portion 4*c* of the lock pin 4, the lock pin 4 is able to overcome any magnitude of inertial force applied to the inertia lever 7.

Here, if the movement restrictors 7*c* and 7*d* are not formed obliquely, the movement restrictors 7*c* and 7*d* must have a linear or circular form. The linear or circular movement restrictors, however, results only in line-contact with the contact portion 4*c*, and cannot effectively prevent rotation of the inertia lever 7.

The present invention is devised to provide a double safety device to more reliably prevent unexpected disengagement between the tongue plate and the buckle due to inertial force, wherein the inertia lever 7 and the torsion spring 8 are linked to each other. More particularly, the stoppers 7*e* and 7*f* are provided at a lower surface of the inertia lever 7 to prevent the inertia lever 7 from being over-rotated beyond a restriction range of the lock pin 4 due to an excessively fast rotation angular velocity thereof, and in turn, the holding recesses 7*l* and 7*m* are obliquely defined in side surfaces of the stoppers 7*e* and 7*f*. As the rod 8*c* of the torsion spring 8 is brought into contact with and is caught by the holding recesses 7*l* and 7*m*, the torsion spring 8, which is completely compressed upon receiving a torque, is kept in a rigid state so as not to be further rotated, acting to stop rotation of the inertia lever 7.

In the present invention, although the above mentioned disengagement caused by rotation of the inertia lever 7 in a release direction can be sufficiently prevented even by the surface contact between the oblique movement restrictors 7*c* and 7*d* and the contact portion 4*c* of the lock pin 4, it is desirable that the torsion spring 8 be disposed below the inertia lever 7 in order to provide the seatbelt buckle with an enhanced safety.

In the above-described anti-rotation configuration according to the present invention, the surface contact between the lock pin and the inertia lever may be replaced by any other configurations. For example, without change in the configuration of the torsion spring of the double safety device, only the movement restrictors of the inertia lever and the contact portion of the lock pin may be changed in configuration. As shown in FIG. 8, in an alternative embodiment, the movement restrictors 7*c* and 7*d* of the inertia lever 7 may be obliquely formed with an inclination and the contact portion 4*c* of the lock pin 4 may have a circular form. In another alternative embodiment, the movement restrictors 7*c* and 7*d* of the inertia lever 7 may have a circular form and the contact portion 4*c* of the lock pin 4 may have a straight form.

Meanwhile, the rotation restrictors 7*g* and 7*h* of the inertia lever 7 are provided to prevent the inertia lever 7 from being rotated in a non-release direction of the release button 1 and lock pin 4. The rotation restrictors 7*g* and 7*h* are disposed on the seating portions 9*m* and 9*n* of the base 9. The rotation restrictors 7*g* and 7*h* function to prevent the inertia lever 7 from being rotated downward from the base 9, thereby preventing the inertia lever 7 from interfering with operations of the tongue plate and ejector 2.

Specifically, when acceleration is applied to pull down the buckle, the release button 1 and lock pin 4 tend to be moved in a non-release direction, but the stoppers 1*c* and 1*d* of the release button 1 are brought into contact with the anti-separating portions 9*k* and 9*l* of the base 9, thereby preventing the non-release movement of the release button 1 and lock pin 4. In addition, although the inertia lever 7 tends to be rotated in the same direction as the non-release movement direction, since the inertia lever 7 is located behind the lock pin 4 rather than being interlocked with the release button 1 as in the conventional buckle configuration, movement of the inertia lever 7 has no effect on movement of the release button 1 and lock pin 4 in a non-release direction. This can eliminate a problem of the conventional buckle configuration in that the release button 1 is unexpectedly moved in a release direction by movement of the inertia lever 7.

The pivoting shafts 9*c* and 9*d* protruding from the sidewalls 9*a* and 9*b* of the base 9 are fitted into the pivoting holes 7*a* and 7*b* of the inertia lever 7. The pivoting shafts 9*c* and 9*d* have an oval cross section and are gradually tapered. Accordingly, the pivoting shafts 9*c* and 9*d* are able to be introduced into the pivoting holes 7*a* and 7*b* starting from relatively thinner portions thereof, thereby being stably caught by the pivoting holes 7*a* and 7*b* of the inertia lever 7 via appropriate rotation thereof. The pivoting shafts 9*c* and 9*d* protruding from the base 9 are formed by embossing. Similarly, the first supporters 9*e* and 9*f* of the base 9, used to support the coils 8*d* and 8*e* of the torsion spring 8, are formed by embossing.

Referring to FIG. 6 illustrating the configuration of the torsion spring 8 according to the present invention, to install the torsion spring 8 to the base 9, the arms 8*g* and 8*f* of the torsion spring 8 between the rod 8*c* and the respective coils 8*d* and 8*e* are first elastically deformed outward by a predetermined angle and thereafter, the arms 8*g* and 8*f* are again pressed toward each other so as to allow the torsion spring 8 to be inserted into the base 9. Once the coils 8*d* and 8*e* are disposed on and supported by the first supporters 9*e* and 9*f*, the press force applied to the arms 8*g* and 8*f* is gradually removed, and a tensile force applied to opposite sides of the first supporters 9*e* and 9*f* is gradually increased. In this way, the arms 8*g* and 8*f* can be stably secured by the first supporters 9*e* and 9*f* without a risk of being separated or loosened from the first supporters 9*e* and 9*f*.

The torsion spring 8 having the increased tensile force as described above is connected to the inertia lever 7 as the torsion spring 8 presses opposite sides of the inertia lever 7 while coming into contact with a lower end of the inertia lever 7. This configuration advantageously prevents unexpected movement of the inertia lever 7 due to the tensile force of the torsion spring 8.

FIG. 7 illustrates coupling relationship between the base 9, inertia lever 7 and torsion spring 8 in accordance with the present invention.

FIG. 9 illustrates alternative embodiments of the coupling relationship between the base 9 and the inertia lever 7. Now, detailed configurations of these alternative embodiments will be described.

Figure 9A:
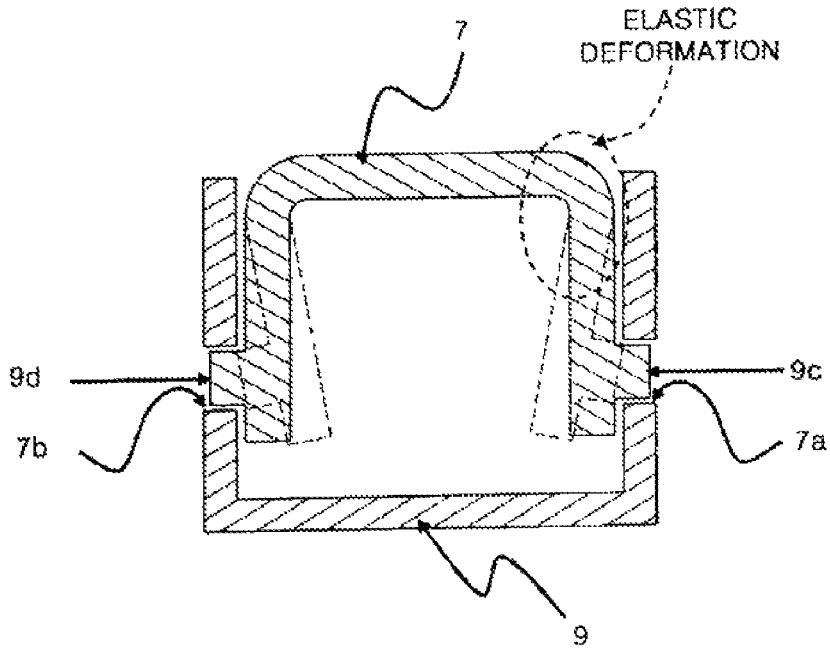
FIG. 9 is a configuration view illustrating alternative embodiments of the coupling relationship between the inertia lever and the base in accordance with the present invention.

In FIG. 9A, the inertia lever 7 may be provided with the pivoting shafts 9*c* and 9*d* as protrusions, whereas the base 9 may be formed with the pivoting holes 7*a* and 7*b* to allow the pivoting shafts 9*c* and 9*d* of the inertia lever 7 to be obliquely inserted when the inertia lever 7 is elastically deformed by a predetermined angle. Then, in a state wherein the elastically deformed inertia lever 7 is pressed for assembly with the base 9, the pivoting shafts 9*c* and 9*d* of the inertia lever 7 are inserted into the pivoting holes 7*a* and 7*b* of the base 9. Then, if the press force applied to the inertia lever 7 is removed, the inertia lever 7 can be stably secured in the base 9 without a risk of being separated or loosened from the base 9 by a restoration force of the inertia lever 7.

Figure 9B:
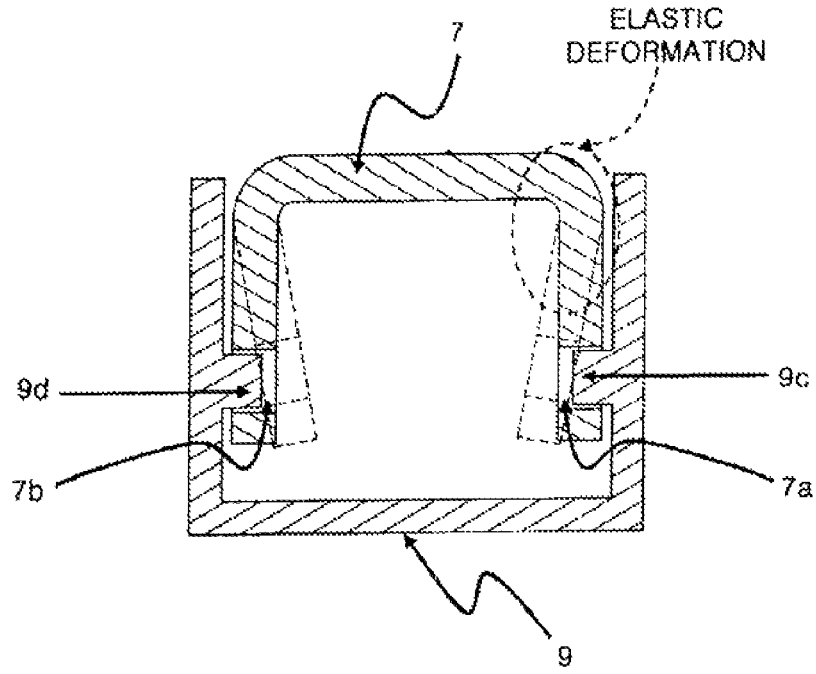

In FIG. 9B, on the contrary, the base 9 may be provided with the pivoting shafts 9*c* and 9*d* in the form of cylindrical protrusions, and the inertia lever 7 may be formed with the pivoting holes 7*a* and 7*b* to allow the pivoting shafts 9*c* and 9*d* to be obliquely inserted when the inertia lever 7 is elastically deformed by a predetermined angle. Then, in a state wherein the elastically deformed inertia lever 7 is pressed for assembly with the base 9, the pivoting shafts 9*c* and 9*d* of the base 9 are inserted into the pivoting holes 7*a* and 7*b* of the inertia lever 7. Then, if the press force applied to the inertia lever 7 is removed, the inertia lever 7 can be stably secured in the base 9 without a risk of being separated or loosened from the base 9 by a restoration force of the inertia lever 7.

In the present invention, the rotation angular velocity of the inertia lever 7 has a difference with the movement velocity of the release button 1 and lock pin 4 under the influence of inertial force, in order to prevent the above mentioned disengagement between the tongue plate and the buckle. The present invention eliminates a need to increase the weight of an inertia lever included in a conventional shockproof device and consequently, has an advantage of eliminating implementation of sintering treatment suitable to increase the specific gravity and weight of the inertia lever. On the basis of this advantage, according to the present invention, the inertia lever 7 may be integrally fabricated using a general metal plate and therefore, can achieve a reduction in manufacturing costs owing to the use of low cost materials and simplified mass production thereof. As a result, the shockproof device for the seatbelt buckle according to the present invention can minimize an increase in price due to the provision thereof.

As is apparent from the above-described configuration of the present invention, the shockproof device is installed behind the release button and the lock pin. With this configuration, the shockproof device can completely prevent the release button from being unexpectedly released when the release button is moved in a non-release direction. Also, even when the release button and lock pin are moved in a release direction, on the basis of the rotation angular velocity of the inertia lever rather than the rotation torque of the inertia lever, the surface contact between the lock pin and the inertia lever can be accomplished, and simultaneously, owing to an anti-rotation structure thereof, the inertia lever can reliably prevent unexpected disengagement between the tongue plate and the buckle even under the influence of any magnitude of inertial force. Further, low weight of the inertia lever enables fabrication of the shockproof device using a metal plate, resulting in enhanced price competitiveness. In the case of the conventional shockproof device previously described herein, the shockproof device is directly linked to the release button and thus, operation of the shockproof device interferes with operation of the release button even during general operations of the seatbelt buckle, causing an increased possibility of disengagement. However, according to the present invention, there is no linkage in operation between the shockproof device and the release button, and this has the effect of preventing generation of operating noises, and the resulting configuration of the present invention enables easy reduction in the overall weight of the seatbelt buckle as compared to the conventional configuration.

As described above, according to the present invention, the inertia lever does not operate upon general locking/unlocking of the seatbelt buckle, and has no effect on disengagement between the tongue plate and the buckle in a non-release direction thereof.

Industrial Applicability

The present invention is applicable to industries related to fabrication of a vehicle seatbelt and buckle thereof. More particularly, the present invention relates to a shockproof device for a seatbelt buckle comprising an inertia lever, which functions to prevent a release button from unwontedly releasing engagement between a tongue plate and the buckle under the influence of inertial force.

With this configuration, it is possible to reliably prevent unexpected disengagement even upon the occurrence of any magnitude of inertial force, to enable fabrication of the shockproof device using a press method without increasing the weight of the inertia lever, and to achieve a reduction in manufacturing costs via the reduced overall weight.

The invention claimed is:

1. A seatbelt buckle with a shockproof device comprising:
- a release button to release a lock mechanism;
- an ejector to eject a tongue plate out of the buckle using elasticity of an ejector spring coupled thereto;
- a lock pin used to operate the release button and configured to he brought into contact with an inertia lever;
- a lock spring to press and return the release button to an initial position;
- a lock plate having a latch to restrict unexpected ejection of the tongue plate;
- the inertia lever to prevent, movement of the release button and the lock pin under an influence of inertial force;
- a torsion spring to support operation of the inertia lever; and
- a base in which the inertia lever and the torsion spring are received, the base being coupled with the release button, wherein the inertia lever includes:
- pivoting holes, into which pivoting shafts of the base are fitted, upon movement of inertia lever in a release direction; and
- rotation restrictors to prevent the inertia lever from being rotated in a non-release direction, the rotation restrictors being disposed on seating portions of the base, wherein the torsion spring includes:
- a rod to he brought into contact with and he caught by holding recesses of the inertia lever;
- coils supported on first supporters of the base; and
- holding portions supported on second supporters of the base, and
- wherein the first supporters of the base used to support the coils are integrally formed with the base by embossing.

2. The seatbelt buckle according to claim 1, wherein the inertia lever further includes a weight provided at an upper end thereof, to set a faster rotation angular velocity of the inertia lover than a movement velocity of the release button and the lock, pin caused under the influence of inertial force.

3. The seatbelt buckle according to claim 1, wherein the inertia lever further includes movement restrictors having an obliquely inclined form to achieve surface contact with a contact portion of the lock pin upon occurrence of a high magnitude of inertial force.

4. The seatbelt buckle according to claim 1, wherein the inertia lever is integrally formed with the pivoting holes, movement restrictors to prevent movement of the inertia lever in a release direction due to inertial force of the release button and the lock pin, the rotation :restrictors to prevent rotation of the inertia lever in a non- release direction, stoppers to prevent over-rotation of the inertia lever in a release direction, and a weight to increase a rotation angular velocity of the inertia lever.

5. The seatbelt buckle according to claim 4, wherein the inertia lever is made of a metal plate.

6. The seatbelt buckle according to claim 1, wherein the torsion spring further includes arms between the rod and the respective coils, the arms being elastically deformed outward by a predetermined angle to apply a tensile force to opposite sides of the first supporters.

7. The seatbelt buckle according to claim 1, wherein the pivoting shafts provided, respectively, at opposite sidewalls of the base have an oval cross section and are gradually tapered, such that the pivoting shafts are introduced into the pivoting holes of the inertia lever starting from relatively thinner portions thereof, thereby being stably caught by the pivoting holes of the inertia lever via rotation thereof.

8. The seatbelt buckle according to claim 1, wherein the inertia lever is provided with the pivoting shafts as protrusions and the base is provided with the pivoting holes, whereby the pivoting shafts of the inertia lever are obliquely inserted into the pivoting holes of the base in a state in which the inertia lever is elastically deformed and pressed.

9. The seatbelt buckle according to claim 1, wherein the pivoting shafts of the base take a form of cylindrical protrusions and are adapted to he obliquely inserted into the pivoting holes of the inertia lever in a state in which the inertia lever is elastically deformed and pressed.

10. The seatbelt buckle according to claim 1. wherein the inertia lever is located behind the release button and the lock pin, to facilitate movement of the release button and the lock pin in a non-release direction, so as not to have an effect on the movement of the release button and the lock pin.

11. The seatbelt buckle according to claim 1, wherein the base includes:

a tongue plate insertion path;

a pair of upright sidewalls provided at opposite sides of the insertion path;

a coupling slot, through which the latch of the lock plate is inserted;

the pivoting shafts provided at the sidewalls, respectively, so as to he rotatably fitted into the respective pivoting holes of the inertia lever;

the seating portions on which the rotation restrictors of the inertia lever, which serve to prevent the inertia lever from being rotated in a non-release direction of the release button and the lock pin, are seated;

the first supporters to support the coils of the torsion spring and the second supporters to support the holding portions of the torsion spring, to eliminate frequent oscillations of the inertia lever while enabling correction of a position of the inertia lever;

lock pin movement passages through which the lock pin is coupled to keep the lock plate stably locked;

a movement passage for a movement guide of the release button; and anti-separating portions to prevent the release button from being unexpectedly separated from an interior of the buckle.

* * * * *